US006213079B1

(12) United States Patent
Watanabe

(10) Patent No.: US 6,213,079 B1
(45) Date of Patent: Apr. 10, 2001

(54) LUBRICATING APPARATUS FOR FOUR-CYCLE ENGINES

(75) Inventor: Mitsunori Watanabe, Shizuoka-ken (JP)

(73) Assignee: Fuji Robin Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/317,620

(22) Filed: May 25, 1999

(30) Foreign Application Priority Data

Jun. 3, 1998 (JP) ..... 10-154795
Dec. 28, 1998 (JP) ..... 10-373601

(51) Int. Cl.[7] ..... F01M 9/00
(52) U.S. Cl. ..... 123/196 R
(58) Field of Search ..... 123/196 R; 184/13.1, 184/11.1

(56) References Cited

U.S. PATENT DOCUMENTS 4,628,878 * 12/1986 Nakano et al. ..... 123/196 R
4,688,529 * 8/1987 Mitadera et al. ..... 123/196 R
4,911,120 * 3/1990 Sumi ..... 123/196 R
4,993,380 * 2/1991 Hsu ..... 123/193.2
5,960,764 * 10/1999 Araki ..... 123/196 R

* cited by examiner

*Primary Examiner*—Noah P. Kamen
*Assistant Examiner*—Hyder Ali
(74) *Attorney, Agent, or Firm*—Arent Fox Kintner Plotkin & Kahn, PLLC

(57) ABSTRACT

A lubricating apparatus for small-sized four-cycle engines to be used in portable type bush cutters, knapsack type powered sprayers, etc. In the lubricating apparatus, an oil returning channel is arranged to provide communication between a valve gear room and an oil sump, and an oil inhaling channel is branched from the middle of the oil returning channel so as to provide communication to an opening in an immediate lower portion of a skirt of a piston being at the top dead center. By this means, when a crank room is negatively pressurized, the oil sucked from the valve gear room is taken through the oil inhaling channel being in communication to a point inside a cylinder where the highest negative pressure is generated, and fed into the cylinder. An opening portion of the oil returning channel is provided with a check valve for opening when the engine is upright and closing when the engine inverted or slanted to prevent the backflow of oil from the oil sump to the oil returning channel. In order to carry out the returning of oil to the oil sump securely, the valve gear room further comprises an oil inhaling means being capable of immersing its extremity into the oil collected inside the valve gear room when the engine is put over sideways.

7 Claims, 7 Drawing Sheets

LUBRICATING APPARATUS FOR FOUR-CYCLE ENGINES

BACKGROUND OF THE INVENTION

The present invention relates to a lubricating apparatus for four-cycle engines, and more particularly to a lubricating apparatus for small-sized four-cycle engines to be used in portable type bush cutters, knapsack type powered sprayers, and the like which take a slanted position as one of their work postures.

Generally, engines used as the power units of such machines as portable type cutters (trimmers) for plants and knapsack type powered sprayers to be carried by hand or on operator's back in operation require operational stability even in the cases where the machines are slanted in use.

Among various types of engines, two-cycle engines comprise a mechanism for carrying out the lubrication of moving parts by inhaling lubricating oil and fuel into the inside of the engines by means of negative pressures created in rising pistons; therefore, construction being capable of free-angle use can be easily obtained therefrom. On this account, two-cycle engines are widely used for the above-mentioned portable type machines.

Meanwhile, four-cycle engines also as another type of engines can be made into small-sized and light-weighted ones due to progress in design and manufacturing technology. However, on account of adopting such construction that the oil sump (oil pan) as a component part of the lubricating apparatus is arranged under a crank room and oil is splashed up or pumped up from the oil sump to lubricate moving parts, four-cycle engines are supposed to be used basically in an upright state. In other words, four-cycle engines are inferior to two-cycle ones in lubricating mechanisms.

However, two-cycle engines in turn have problems in higher content of hydrocarbon in their exhaust gas and louder noise. Accordingly, in terms of exhaust gas clean-up and prevention of working-environment deterioration, it has been desired in recent years to use four-cycle engines being favorable in exhaust gas property and low in noise for the portable machines.

In view of the foregoing, the applicant of the present invention has previously proposed a lubricating apparatus for four-cycle engines which utilizes the phenomenon that the pressure in a crank room varies in accordance with the piston's up-and-down movements (e.g., Japanese Patent Application Laid-Open No. Hei 10-288019).

In the proposition, with the oil sump and the crank room completely shut off from each other, an intermittent oil feeding means is to be arranged from the oil sump to a portion in the rotational track of a crankshaft to provide communication between the oil sump and the crank room so that oil is inhaled from the oil sump and fed into the crank room by means of a negative pressure in the crank room. Besides, the crank room is to be further communicated with a valve gear room equipped with cam mechanisms and the installation place of valve drive mechanisms to forcedly send oil mist agitated in the crank room under a positive pressure generated inside the crank room in the descending of the piston.

In the meantime, blowby gas containing the oil mist fed into the valve gear room is to be recovered into the oil sump by means of a negative-pressurization tendency of the oil sump, in other words, by the action of the negative pressure inside the crank room created in the ascending of the piston upon the oil sump.

Including such constitution, however, the pressure in the oil sump increases with a rise in cylinder temperature once engine is started. On account of this, the attempt to recover the oil from the valve gear room into the oil sump sometimes ends up in poor recovery since sufficient negative pressures cannot be obtained inside the oil sump. This excessively retains the oil inside the valve gear room, causing the danger of a lack in lubricating oil for other parts.

In addition to the case of being used under such conditions that the piston in its combustion chamber is reciprocated mostly in a vertical direction, in other words, the crankshaft as an output shaft of power is directed horizontally, a four-cycle engine having constitution described in the aforesaid publication is sometimes used under such conditions that the crankshaft is mostly directed in a vertical direction. The latter use conditions include applications such as a lawn mower.

In the cases where the crankshaft is vertically directed, in other words, the cases of vertical type use, the engine takes a so-called sideways position in which its recoil starter is directed up and the reciprocation direction of the piston becomes horizontal. Here, in the valve gear room into which the oil is collected, the opening of an oil returning channel provided to return the oil component of the oil mist into the oil sump gets out of the oil surface, possibly hampering the smooth returning of oil. Besides, in the cases where a slidably supported portion of a valve is left immersed in the oil, the oil penetrates into the combustion chamber via the slidably supported portion, possibly causing the adverse effects of defective combustion such as white smoke emission and of sticking carbon to the muffler.

SUMMARY OF THE INVENTION

An object of the present invention is to provide a lubricating apparatus for four-cycle engines comprising constitution being capable of securely carrying out internal lubrication in any work posture including slanted positions as well as performing economical lubrication without causing a lack of oil in lubrication-requiring parts.

To achieve the foregoing object, a first aspect of the present invention is to provide a lubricating apparatus for four-cycle engines, for feeding oil from an oil sump provided in the vicinity of a crank room to the crank room and to a valve gear room containing an intake and exhaust valve mechanisms to carry out lubrication of parts and circulate the oil, characterized in that: the oil sump is partitioned from the crank room so as to avoid oil leakage in any slanted state; the lubricating apparatus further comprises a first oil feeding means having an inlet portion configured so that the extremity thereof always remains under the oil surface in the oil sump regardless of the slanted state of the oil sump, the first oil feeding means feeding the oil in the oil sump through the inlet portion to the crank room by means of a negative pressure generated in the crank room, an agitating section provided in the crank room for agitating the oil fed by the first oil feeding means into oil mist, a communicating channel for providing communication between the crank room and the valve gear room, a second oil feeding means for feeding the oil mist in the crank room through the communicating channel to the valve gear room by means of a positive pressure generated in the crank room, and an oil inhaling channel branched from the middle of an oil returning channel so as to provide communication with an opening positioned in an immediate lower portion of a skirt of a piston being at the top dead center, the oil returning channel constituted by piercing so as to provide communication between the valve gear room and the oil sump; and an opening portion of the oil returning channel to the oil sump is provided with a check valve for opening when the engine is upright and closing when the engine is inverted or slanted.

According to the first aspect of the present invention, the oil returning channel is arranged in the crankcase so as to provide the communication between the valve gear room and the oil sump, and from the middle of the oil returning channel is branched the oil inhaling channel which is capable of communication with the opening positioned in the immediate lower portion of the skirt of the piston being at the top dead center. Therefore, when the crank room becomes negative in pressure, the oil is inhaled from the valve gear room and taken into the oil inhaling channel being in communication to the point within the cylinder where the highest negative pressure is generated, and thereby newly supplied into the cylinder. By this means, the highest negative pressure obtained on the arriving of the piston to the top dead center inside the cylinder can be utilized to feed the oil from the valve gear room into the cylinder. This can prevent a lack of lubricating oil inside the cylinder without greatly affected by a change in negative pressure in the oil sump.

Besides, the opening portion of the oil returning channel is provided with the check valve which is opened when the engine is upright and closed when the engine inverted or slanted. This avoids the backflow of oil from the oil sump to the oil returning channel when the engine is in an inverted or slanted state, thereby allowing the solution of such a problem in that excessive lubrication occurs in some work postures of the engine.

In the above constitution, the check valve may be composed of a spherical body for opening and closing the opening portion by means of its own weight. Since the check valve is constituted by a spherical body which is capable of moving in the direction of gravity in accordance with the inverted or slanted state of the engine, the check valve can securely close the opening of the oil returning channel when the engine is inverted or slanted. Therefore, such a problem in that excessive oil intrudes into the valve gear room in some work postures of the engine can be securely avoided, and the proper lubricating function can be maintained.

In addition, a pore for providing communication with the oil sump may be arranged on the communicating channel. The provision of the pore being capable of communication with the oil sump can adjust the oil mist fed to the valve drive section and the valve gear room under a positive pressure of the crank room to its proper amount by releasing an excess thereof to the oil sump, so as to prevent excessive supply of the oil mist.

Furthermore, in the above mentioned constitution, a breather pipe may be brought into communication from the valve gear room to a breather room of an air cleaner, and a pipe may be arranged to provide communication between the breather room and an oil inhaling opening formed in an immediate lower portion of the skirt of the piston being at the top dead center of the piston in a cylinder, so as to feed the oil held in a lower part of the breather room into the cylinder through the oil inhaling opening in the immediate lower portion of the skirt when the piston is at the top dead center.

Therefore, the oil being contained in the blowby gas recovered from the valve gear room can be recovered in the breather room and newly supplied into the cylinder before collected into the oil sump. Here, the highest negative pressure generated on the arrival of the piston to the top dead center can be applied to the breather room to inhale the oil into the cylinder. This allows the oil recovered in the breather room to be fed into the cylinder, which is one of the lubrication-requiring parts, without being affected by changes in negative pressure in the oil sump; therefore, it becomes possible to lower the consumption amount of as well as prevent a lack of lubricating oil, suppressing a rise of maintenance costs.

Furthermore, in view of the aforesaid problems in the conventional lubricating mechanisms, another object of the present invention is to provide a lubricating apparatus for four-cycle engines comprising constitution being capable of preventing defective combustion from occurring and of securely carrying out the returning of oil inside the valve gear room mainly in using the engines in a sideways state.

A second aspect of the present invention is to provide a lubricating apparatus for four-cycle engines, for feeding oil from an oil sump provided in the vicinity of a crank room to the crank room and to a valve gear room containing an intake and exhaust valve mechanisms to carry out lubrication of parts and circulate the oil, characterized in that: the oil sump is partitioned from the crank room so as to avoid oil leakage in any slanted state; the lubricating apparatus further comprises a first oil feeding means having an inlet portion configured so that the extremity thereof always remains under the oil surface in the oil sump regardless of the slanted state of the oil sump, the first oil feeding means for feeding the oil in the oil sump through the inlet portion to the crank room by means of a negative pressure generated in the crank room, an agitating section provided in the crank room for agitating the oil fed by the first oil feeding means into oil mist, a communicating channel for providing communication between the crank room and the valve gear room, a second oil feeding means for feeding the oil mist in the crank room through the communicating channel to the valve gear room by means of a positive pressure generated in the crank room, and an oil inhaling channel branched from the middle of an oil returning channel so as to provide communication with an opening positioned in an immediate lower portion of a skirt of a piston being at the top dead center, the oil returning channel constituted by piercing so as to provide communication between the valve gear room and the oil sump; and the oil returning channel has an oil suction means detachably arranged on its opening in the valve gear room; and the oil suction means is capable of immersing an extremity thereof into oil when the engine is put over sideways.

According to the second aspect of the present invention, the oil returning channel is arranged so as to provide the communication between the valve gear room and the oil sump, and onto the opening of the oil returning channel positioned in the valve gear room is arranged the oil suction means being capable of immersing an extremity thereof into the oil being collected when the engine is in a sideways state. By this means, the oil returning channel and the oil can be continuously kept in communication to secure the returning of oil to the oil sump. Accordingly, the oil to be recovered within the valve gear room can be prevented from a failure in recovery as well as from intrusion into the combustion chamber via the slidably supported portion of the valve to avoid the defective combustion.

In the above mentioned constitution, the oil suction means may be composed of a pipe formed from the oil returning channel so as to be bent toward the inside of the oil and rotate freely about the longitudinal axial center of the oil returning channel, and may have a weight member mounted on the extremity thereof to be immersed into the oil.

Alternatively, the oil suction means may be formed of a flexible pipe, and may have a weight member mounted on the extremity thereof to be immersed into the oil.

Since the oil suction means being rotatable or having flexibility has the weight member mounted on its extremity to be immersed into oil, in any posture of the engine including a sideways state, the extremity of the oil suction means can be immersed into the oil being collected in the direction of gravity to securely carry out the intake of oil into the oil returning channel. Accordingly, the recovery of oil component from the valve gear room can be prevented from a failure to avoid the occurrence of defective combustion resulting from the intrusion of oil into the combustion chamber.

The above objects and features of the present invention will become better understood from the following description with reference to the accompanying drawings.

DETAILED DESCRIPTION OF THE PREFERRED EMBODIMENTS

Figure 1:
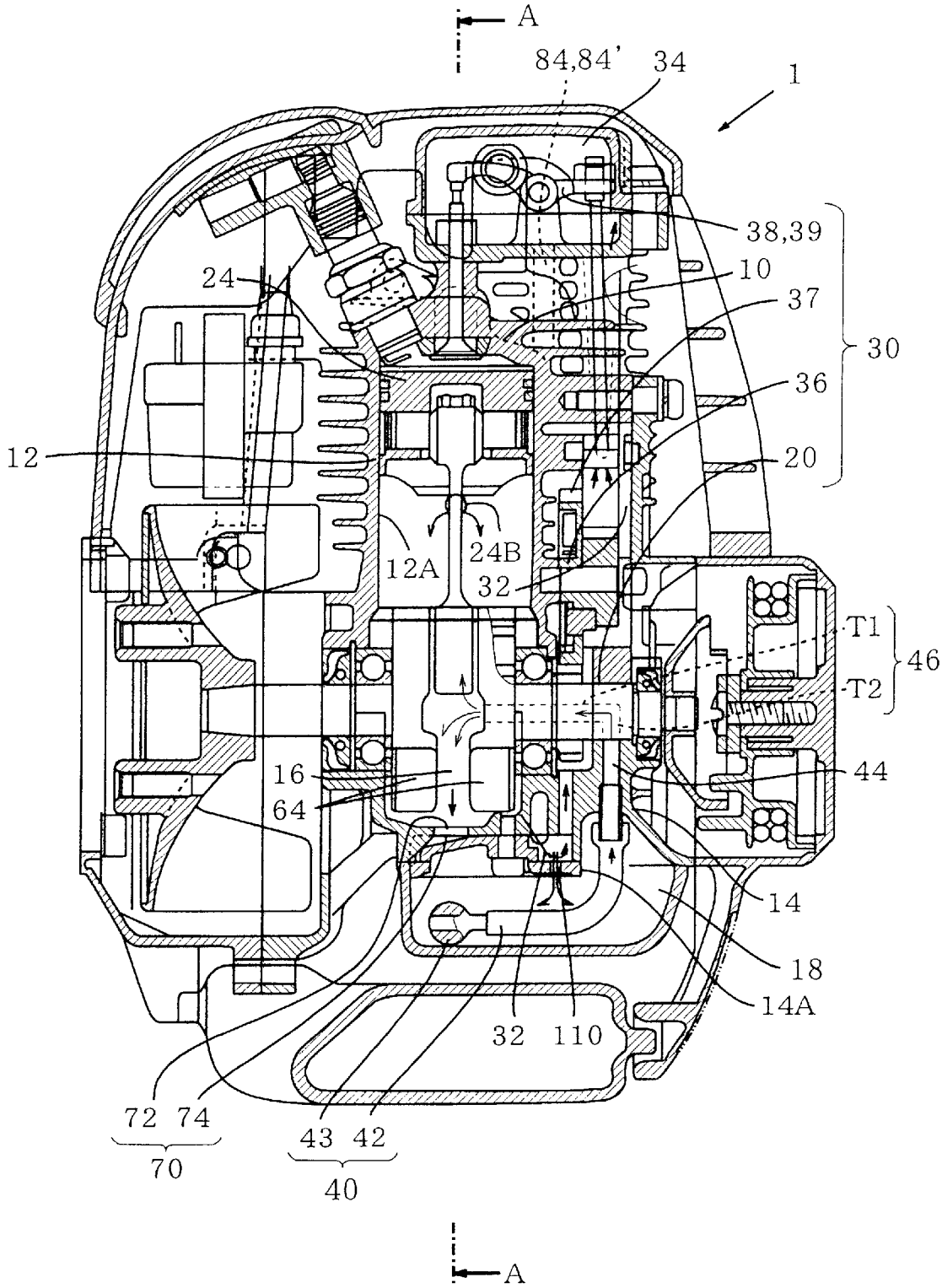
FIG. 1 is a sectional view of a four-cycle engine to which the lubricating apparatus according to a first embodiment of the present invention is applied, as seen from the front side.
Figure 2:
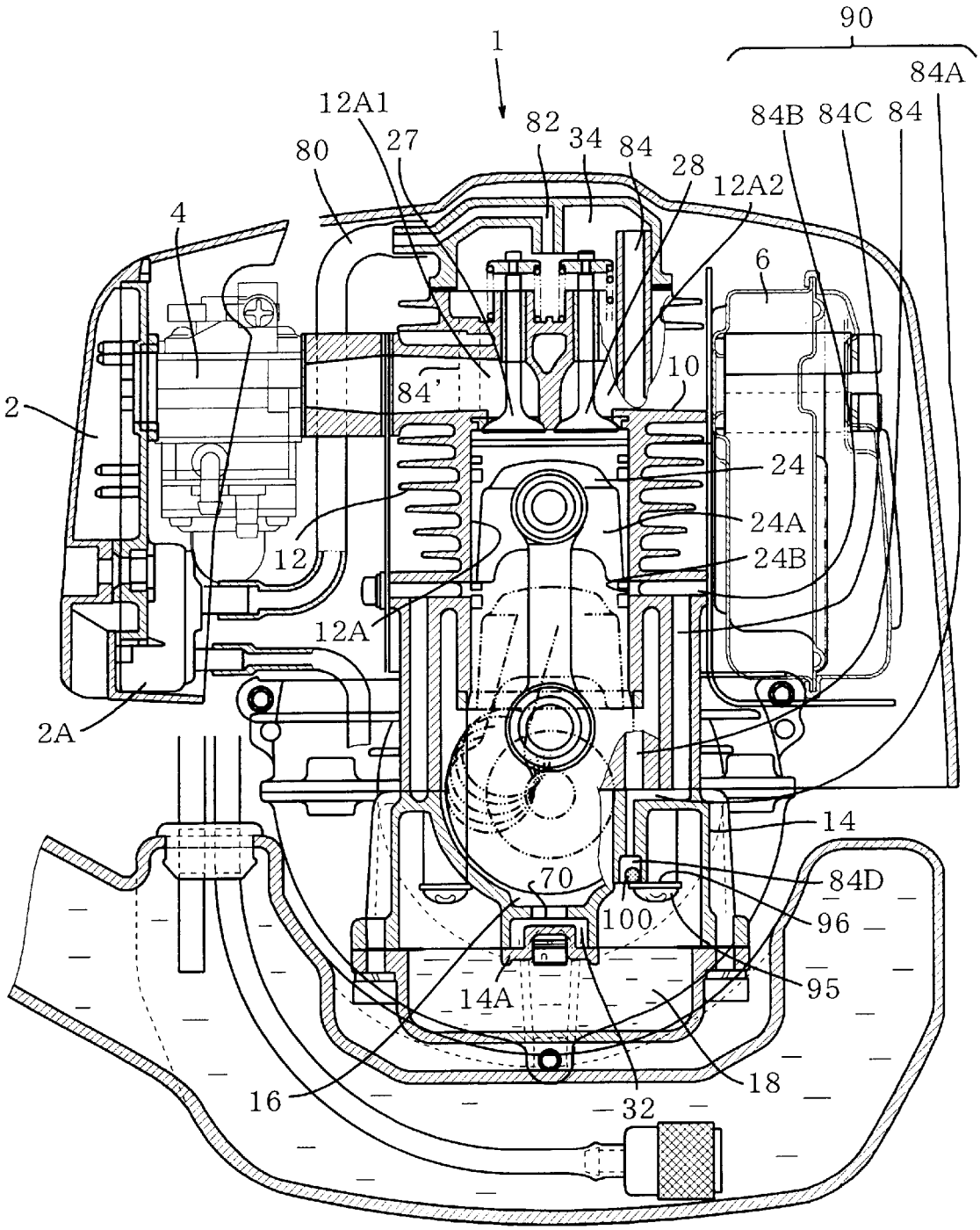
FIG. 2 is a sectional view with portions seen in the direction shown by symbols A in FIG. 1.
Figure 3:
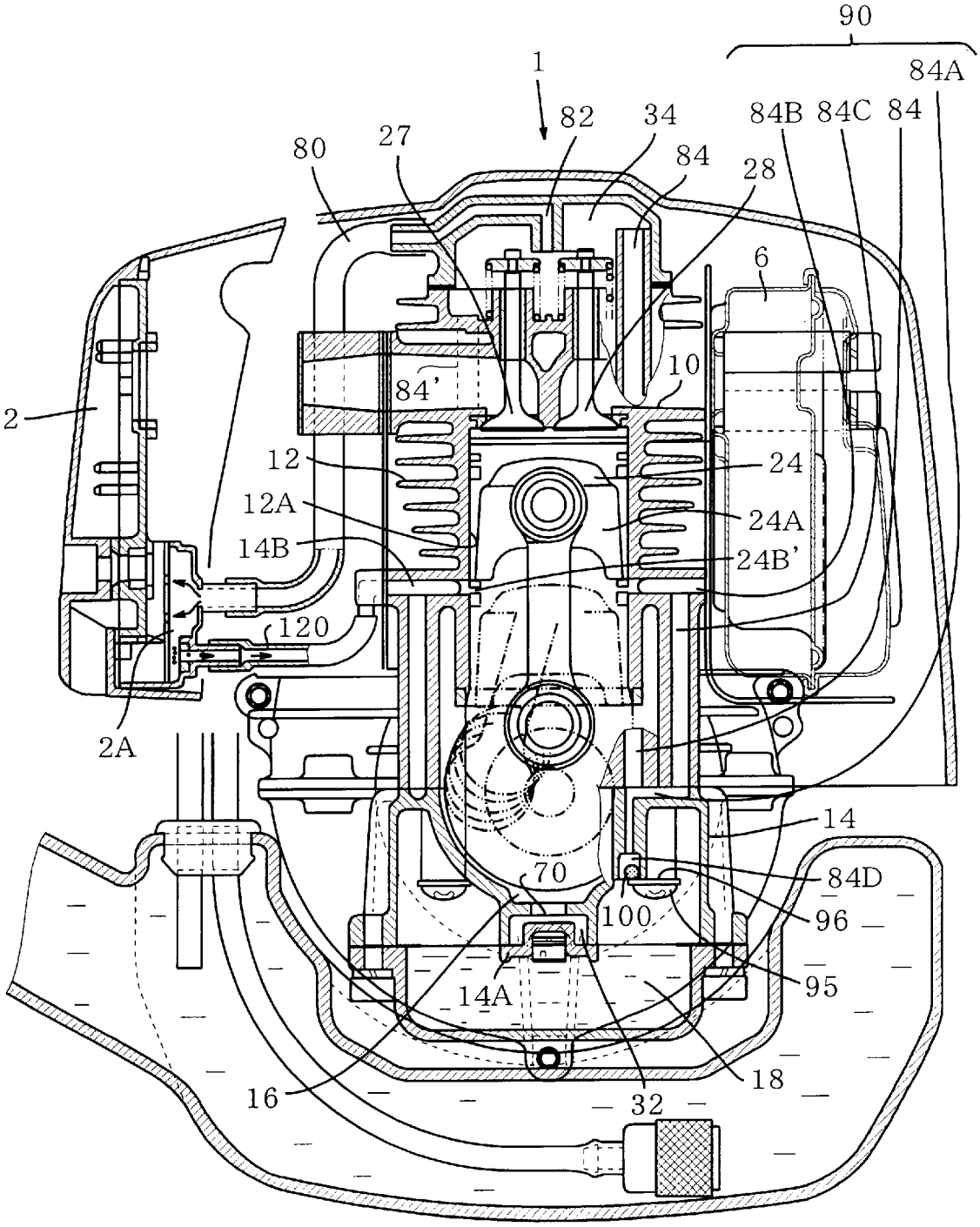
FIG. 3 is a sectional view with other portions seen in the direction shown by the symbols A in FIG. 1.

FIG. 1 is a front sectional view of a four-cycle engine to which the lubricating apparatus according to an embodiment of the present invention is applied. FIGS. 2 and 3 are a sectional view with portions seen in the direction shown by symbols A in FIG. 1 and a sectional view with other portions seen in the direction shown by the symbols A in FIG. 1, respectively.

The four-cycle engine shown in FIG. 1 is provided with the constitution disclosed in the specification document appended to the application form in Japanese Patent Application Laid-Open No. Hei 10-288019 as its principal part. Hereinafter, description will be given of the above-mentioned constitution before the description of the present embodiment.

A four-cycle engine 1, as shown in FIG. 2, comprises air cleaner 2 and a carburetor 4 arranged on the left side and an exhaust muffler 6 on the right side. The four-cycle engine 1 further comprises: a crank room 16 composed of a crankcase 14 and a cylinder block 12 integrated with a cylinder head 10; and an oil sump 18 provided in the vicinity of the lower portion of the crankcase 14. The oil sump 18 is partitioned from the crankcase 14 with a partition wall 14A, forming an hermetically sealed space as a whole.

In FIG. 1, the crankcase 14 over the partition wall 14A is provided with an inlet portion 40 as described below and a unidirectional valve 70. The unidirectional valve 70 is constituted so as to be opened and closed in accordance with a change in pressure inside the crank room 16, and is closed in the case of no pressure change to avoid outward oil leakage in any slanted position of the oil sump 18.

To the cylinder block 12 and the crankcase 14 is, as shown in FIG. 1, rotatably supported a crankshaft 20 with its axis horizontal. A piston 24 connected via a connecting rod to a crank pin of the crankshaft 20 is slidably fitted into a cylinder 12A provided inside the cylinder block 12.

In FIG. 2, in upper walls of the cylinder 12A are formed an intake port 12A1 and an exhaust port 12A2 in communication with the carburetor 4 and the exhaust muffler 6, respectively. To the ports are arranged an intake valve 27 and an exhaust valve 28 for opening and closing the ports, respectively.

A valve drive section 30 for driving these valves is, as shown in FIG. 1, composed of such component parts as a valve drive gear 36, a cam gear 27, and rocker arms 38, 39. Among these component parts of the valve drive section 30, the valve drive gear 36 and the cam gear 37 are arranged in a communicating channel 32, which is formed at side portions of the cylinder block 12 and the crankcase 14 so as to provide communication between the crank room 16 and a valve gear room 34 formed in the cylinder block 12.

Between the crank room 16 and the oil sump 18 are provided the inlet portion 40, a path 44, and an intermittent oil feeding section 46 as a first oil feeding means.

In FIG. 1, the inlet portion 40 is composed of a flexible tube 42 of elastic material such as rubber and a weight 43 attached to an end thereof. More specifically, the weight 43 is provided so as to always move vertically downwards by means of its own weight to keep the end of the inlet portion 40 immersed under the oil surface even when the oil sump 18 is slanted.

The other end of the inlet portion 40 is communicated with the path 44 piercing through the crankcase 14. The path 44 forms an arcuate opening at a portion facing to the outer periphery of the crankshaft 20.

In FIG. 1, the intermittent oil feeding section 46 through the crankshaft 20 is composed of: a path T1 of a prescribed internal diameter drilled from a crank room 16 side through the vicinity of the center of the crankshaft 20 without piercing through outside; and a path T2 drilled in a radial direction into the crankshaft 20 to be connected to the path T1. The path T2 is provided so as to be communicated with the path 44 in the crankcase 14 within rotating angles of the crankshaft 20 corresponding to the negative-pressurization of the crank room 16 resulting from the ascending of the piston 24. In other words, the path T2 and the path 44 in the crankcase 14 are to be brought into communication in the process of a full revolution of the crankshaft 20.

Therefore, in the ascending of the piston 24, oil is inhaled from the oil sump 18 into the crank room 16 by means of a negative pressure generated in the crank room 16 when the inlet portion 40, the path 44, and the intermittent oil feeding section 46 are communicated through.

In FIG. 1, the crank room 16 comprises agitating sections for agitating the oil fed by the first oil feeding means into oil mist.

More specifically, the agitating sections are composed mainly of crank webs 64 fixed to the crankshaft 20.

In FIGS. 1 and 2, between the crank room 16 and the communicating channel 32 is provided a unidirectional valve 70 as a second oil feeding means.

The unidirectional valve 70 is composed of a valve hole 72 piercing through a lower portion of the crankcase 14, and a valve plate 74 for opening the valve hole 72 when the crank room 16 becomes positive in pressure and closing the valve hole 72 when the crank room 16 becomes negative in pressure in accordance with the up-and-down movements of the piston 24.

In FIG. 2, a breather pipe 80 is provided onto the top of the cylinder block 12. The breather pipe 80 has an end communicated with the inside of the valve gear room 34 via an opening 82, and the other end connected to the air cleaner 2.

The valve gear room 34 comprises oil returning channels 84 and 84'. Each of these has an end opened to the valve gear room 34 and the other end opened to the oil sump 18.

In such constitution, as shown in FIG. 1, being positioned with the valve gear room 34 up, in other words, in an upright state, the engine 1 holds proper amounts of lubricating oil in the crank room 16, oil sump 18, and valve gear room 34 in the case where the piston 24 is not in up-and-down motion.

When the engine 1 is started, the up-and-down movements of the piston 24 generate a change in pressure inside the crank room 16; that is, the ascending of the piston 24 depressurizes the crank room 16 into a negative pressure, and the descending of the same pressurizes the crank room 16 into a positive pressure.

The negative-pressurization of the crank room 16 produces a differential pressure between the crank room 16 and the oil sump 18. As a result, the oil held in the oil sump 18 is sent to the crank room 16 side through the inlet portion 40 and the paths T1, T2 of the intermittent oil feeding section 46 (cf. FIG. 1) being provided in the rotating crankshaft 20 so as to be in communication with the oil sump 18 in the ascending of the piston 24.

The oil sent to the crank room 16 side is delivered to the crank webs 64, scattered from the end portions thereof about the inner walls of the crank room 16, and thereby partially formed into oil mist. The thus produced oil mist lubricates the crankshaft 20, the piston 24, and other component parts in the crank room 16.

In the descending of the piston 24, the crank room 16 becomes positive in pressure, generating a differential pressure against the oil sump 18. In this case, the valve plate 74 in the unidirectional valve 70 (cf. FIG. 2) opens the valve hole 72, so that the oil mist held in the crank room 16 and the cylinder 12A is sent from the crank room 16 into the communicating channel 32 together with the pressurized air.

The oil mist sent into the communicating channel 32 is in turn sent toward the valve gear room 34 under the positive pressure, lubricating the component parts of the valve drive section 30 on the way.

The oil mist having lubricated the respective component parts of the valve drive section 30 is introduced to the valve gear room 34, in which the oil mist is separated into oil and air. The separated oil is let through the oil returning channels 84 and 84' to the oil sump 18 for recovery. Meanwhile, the separated air is let from the opening 82 through the breather pipe 80, and released into the air cleaner 2. Note that this air contains some amount of oil mist.

Next, in the cases where the engine 1 is used in an inverted state, the weight 43 arranged on the end of the inlet portion 40 changes its position along the direction of gravity inside the oil sump 18 to immerse the inlet portion 40 into the held oil, which carries out the supplying of oil to respective lubrication parts by utilizing the changes in pressure resulting from the up-and-down movements of the piston 24. The oil supply is also performed in the same way in the cases where the engine 1 in a slanted state.

Now, the constitution providing the features of the present embodiment will be explained below on the constitution of the lubricating apparatus described above.

With reference to FIG. 2, one of the two oil returning channels 84 and 84' of generally the same constitution having an end arranged inside the valve gear room 34 will now be described in constitutional detail. The other end of the oil returning channel 84 is opened to the top of the oil sump 18, and a bypass structure is arranged on the middle. Noted that, while description will be omitted thereon, the other oil returning channel 84' is of the same constitution as that of the oil returning channel 84.

The bypass structure is constituted by an oil inhaling channel 90 composed of: a branch channel 84A branching off of the oil returning channel 84; a path 84B being capable of communication with an opening 24B positioned in an immediate lower portion of a skirt 24A of the piston 24 when the piston 24 is at the top dead center; and a path 84C for providing communication between the branch channel 84A and the path 84B. The opening 24B positioned in the immediate lower portion of the skirt 24A is piercing through the skirt 24A to provide communication to the inside of the cylinder 12A. Therefore, when communicated with the path 84B, the opening 24B allows the communication between the path 84B and the inside of the cylinder 12A.

Meanwhile, as shown in FIG. 2, the oil returning channel 84 is provided with a check valve 100 at its opening portion 84D positioned in an upper portion of the oil sump 18. The check valve 100 comprises a spherical body being prevented from dropping-out by a washer 96 which is supported between a bolt 95 and the lower surface of the crankcase 14. While in the present embodiment the spherical body constituting the check valve 100 is composed of a steel ball, it is obvious that the spherical body is not limited thereto, and may be of any other material as long as oilproof.

For example, the above-mentioned spherical body may be composed of a rubber ball of fluororubber, which is low in resilience and has oil- and heat-resistances.

Besides, in FIG. 1, in the vicinity of the communicating channel 32 for providing communication between the crank room 16 and the valve gear room 34, a pore 110 is formed in the partition wall 14A at the bottom of the crankcase 14 to provide communication with the oil sump 18.

As the present embodiment is of the above-described constitution, like the aforementioned case, a differential pressure is produced between the crank room 16 and the oil sump 18 in the ascending of the piston 24 with the engine 1 upright, causing a negative-pressurization tendency in the crank room 16. On this account, the oil held in the oil sump 18 is sent to the crank room 16 through the inlet portion 40 and the paths T1 and T2 of the intermittent oil feeding section 46 provided in the rotating crankshaft 20 so as to provide communication to the oil sump 18 in the ascending of the piston 24.

When the piston 24 reaches to the top dead center, the path 84B of the oil inhaling channel 90 formed in a part of the oil returning channel 84 from the valve gear room 34 is brought into communication with the opening 24B positioned in the immediate lower portion of the skirt 24A of the piston 24, thereby providing communication to the inside of the cylinder 12A. On this account, when the crank room 16 is negatively pressurized, the oil in the valve gear room 34 is taken into the oil inhaling channel 90 by the negative pressure which peaks at the top dead center of the piston 24, and inhaled through the opening 24B into the cylinder 12, as shown by arrows in FIG. 1. Therefore, most of the oil mist having fed to the valve gear room 34 is inhaled through the oil returning channel 84 into the cylinder 12A by the negative pressure in the crank room 16, and the remaining is sent through the opening portion 82 and the breather 80 to the air cleaner 2.

Now, the descending of the piston 24 turns the crank room 16 positive in pressure. The positive pressure opens the valve plate 74 of the unidirectional valve 70 constituting the second oil feeding means to send the oil misted by the crank webs 64 through the communicating channel 32 to the valve drive section 30 and the valve gear room 34.

The descending of the piston avoids excessive supply of oil to the valve drive section 30 and the valve gear room 34. That is, when the valve plate 74 in the unidirectional valve 70 is opened to let the oil misted inside the crank room 16 through the communicating channel 32, some of the oil let through the communicating channel 32 is released into the oil sump 18 through a pore 110, which is formed in the partition wall 14A of the crankcase 14 so as to be in communication between the communicating channel 32 and the oil sump 18. This accordingly adjusts the oil mist to be fed to the valve drive section 30 and the valve gear room 34 to its proper amount.

Now, in the cases where the engine 1 is in an inverted state, the oil sump 18 is positioned up. Therefore, the oil inside the oil sump 18 possibly flow backward through the oil returning channel 84 opening in the top of the oil sump 18. However, in the present embodiment, the spherical body in the check valve 100 is to close the opening portion 84D of the oil returning channel 84 to avoid the backflow of oil. Such condition is also obtained when the engine is in a slanted state.

According to the present embodiment, a bypass structure is provided on the oil returning channel 84 from the valve gear room 34, and via the oil inhaling channel 90 constituting the bypass structure the oil can be fed into the cylinder 12A through the opening 24B positioned in the immediate lower portion of the skirt 24A of the piston 24 being at the top dead center. Therefore, oil recovered from the valve gear room 34 can be fed substantially by force into the cylinder 12A which is one of the lubrication points.

Hereinafter, another embodiment of the present invention will be described.

FIG. 3 is a sectional view being equivalent to FIG. 2, illustrating the principal parts of a lubricating apparatus according to the another embodiment of the present invention. AS shown in the figure, the present embodiment is characterized in that the oil contained in the blowby gas recovered from a valve gear room 34 is introduced into the cylinder 12A instead of being returned to the oil sump 18. Note that, in FIG. 3, the same component parts as those in FIG. 2 are designated by the same reference numerals and symbols.

In FIG. 3, at a position where a breather pipe 80 is communicated to an air cleaner 2 is arranged a breather room 2A, and from the breather room 2A is extended a pipe 120 for providing communication between the breather room 2A and an oil inhaling opening (for ease of description, designated by a reference numeral 24B') formed in an immediate lower portion of a skirt 24A of a piston 24 being at the top dead center. The pipe 120 is connected to an oil inhaling channel 14B, which is formed in a cylinder 14 so as to be in communication with the aforesaid oil inhaling opening 24B', to provide communication between the aforesaid breather room 2A and the oil inhaling opening 24B'.

In this connection, the pipe 120 may be provided with a check valve (not shown) being capable of supplying oil into the cylinder 12A only when the cylinder 12A side is negative in pressure.

As the present embodiment is of the above-described constitution, in the descending of the piston 24, the blowby gas containing the oil mist is sent through a communicating channel 32 (cf. FIG. 2) to the valve gear room 34 to be separated into oil and air, which are in turn sent into oil returning channels 84, 84' and into an opening portion 82, respectively.

The oil-containing air sent into the opening portion 82 is let through the breather pipe 80 into the breather room 2A, in which the oil-containing air is yet separated into air and oil. By a negative pressure generated in the crank room 16 in the ascending of the piston 24, the oil separated in the breather room 2A is inhaled through the pipe 120 and the oil inhaling channel 14B into the oil inhaling opening 24B' positioned in the immediate lower portion of the skirt 24A of the piston 24, and fed into the cylinder 12A. By this means, after taken from the valve gear room 34 into the breather room 2A and separated, the oil is sent by force to a point inside the cylinder where the highest negative pressure is generated, and is newly supplied to the cylinder 12A for use in lubrication.

According to the present embodiment, the oil separated from air in the breather room 2A is inhaled into the cylinder 12A by the negative pressure created in the ascending of the piston 24. Therefore, the residual oil in the breather room 2A can be reduced in amount, thereby lowering the oil contamination of the air cleaner 2.

Figure 4:
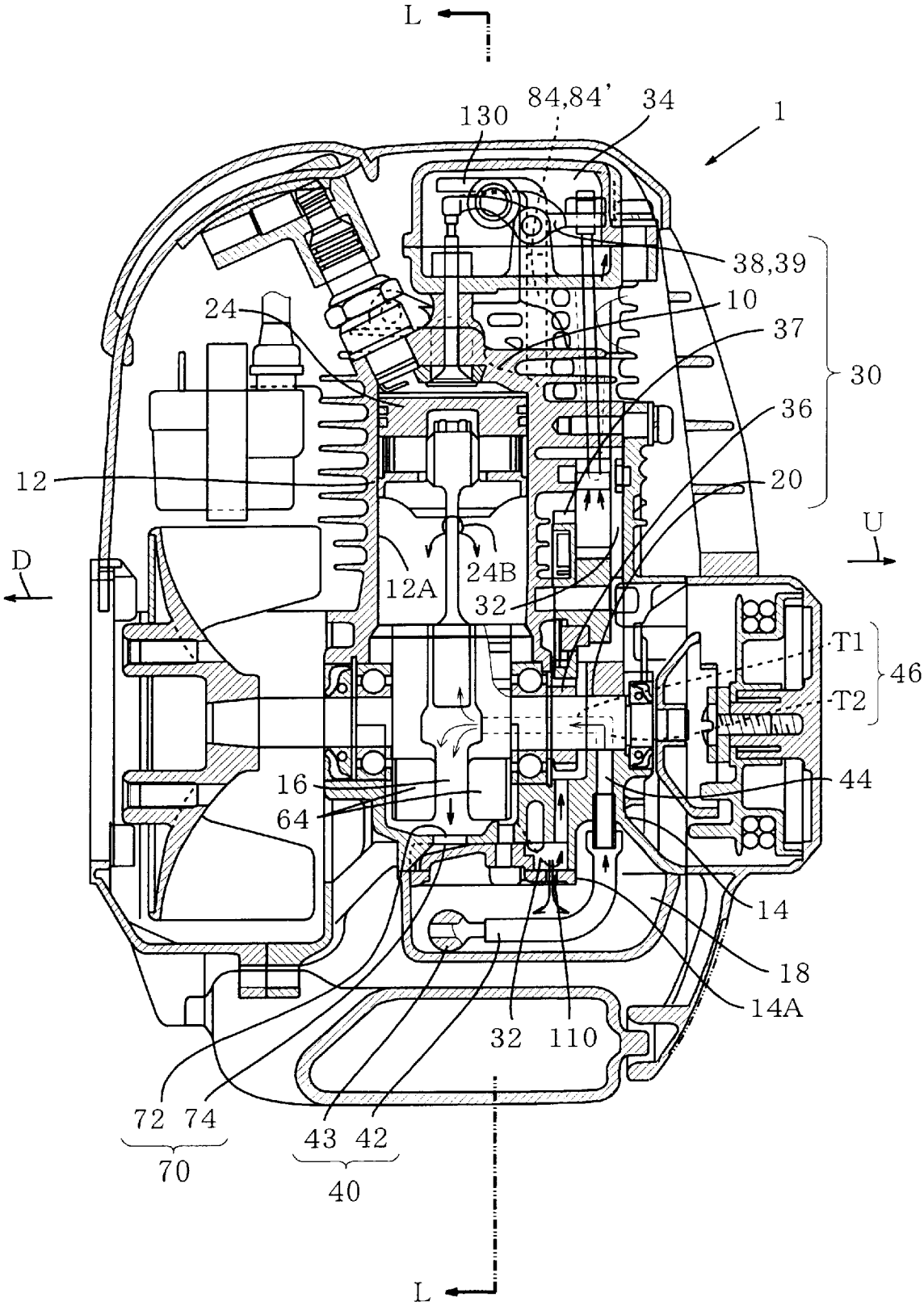
FIG. 4 is a sectional view of a four-cycle engine to which the lubricating apparatus according to a second embodiment of the present invention is applied, as seen in a direction orthogonal to the axial direction of the crankshaft thereof.
Figure 5:
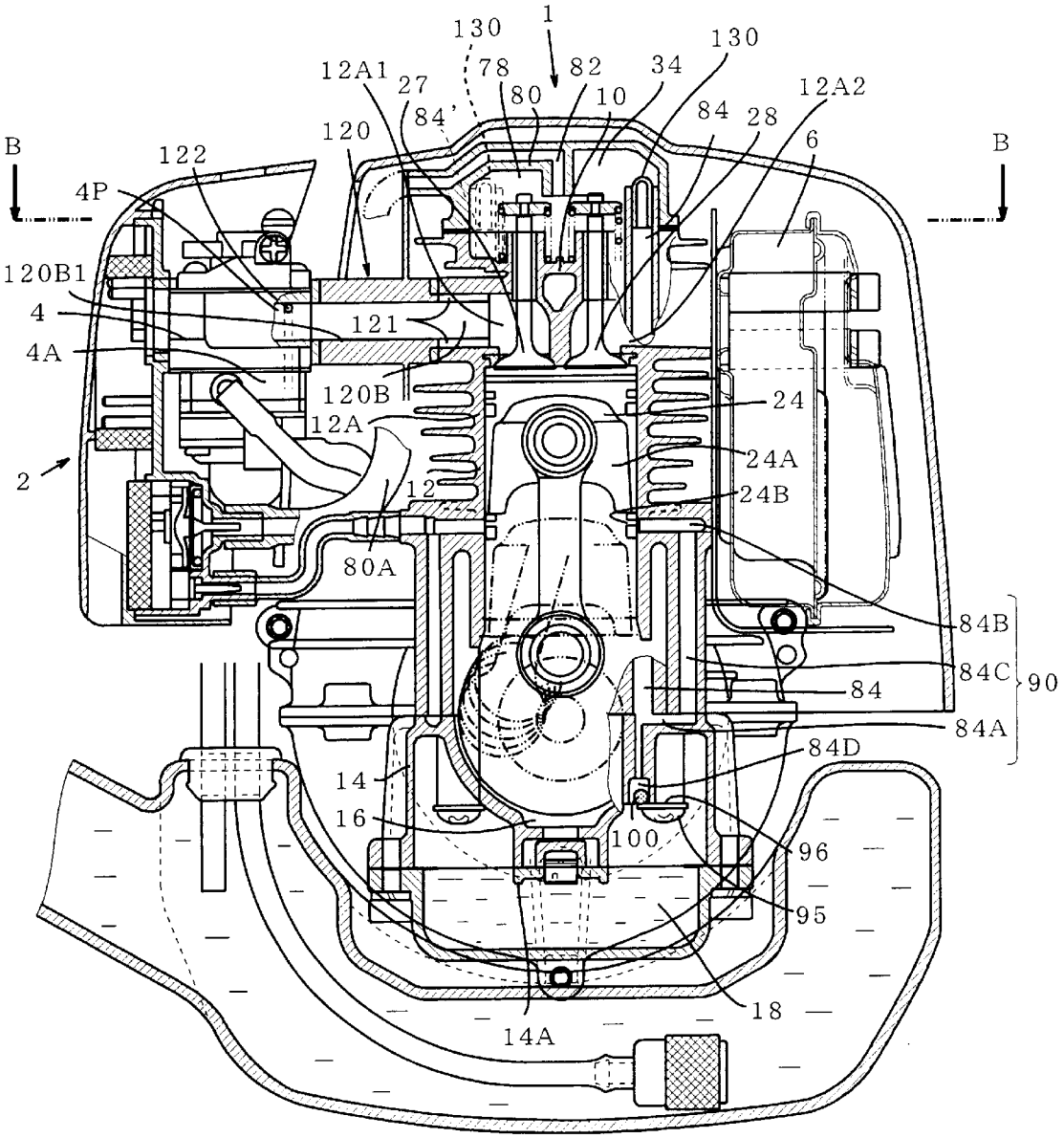
FIG. 5 is a sectional view of the four-cycle engine to which the lubricating apparatus according to the second embodiment of the present invention is applied, as seen from an end side of the crankshaft.

Moreover, as shown in FIGS. 4 and 5, the oil returning channels 84 and 84' are provided with detachable oil suction means 130 onto their openings at the valve gear room 34 side.

Figure 6:
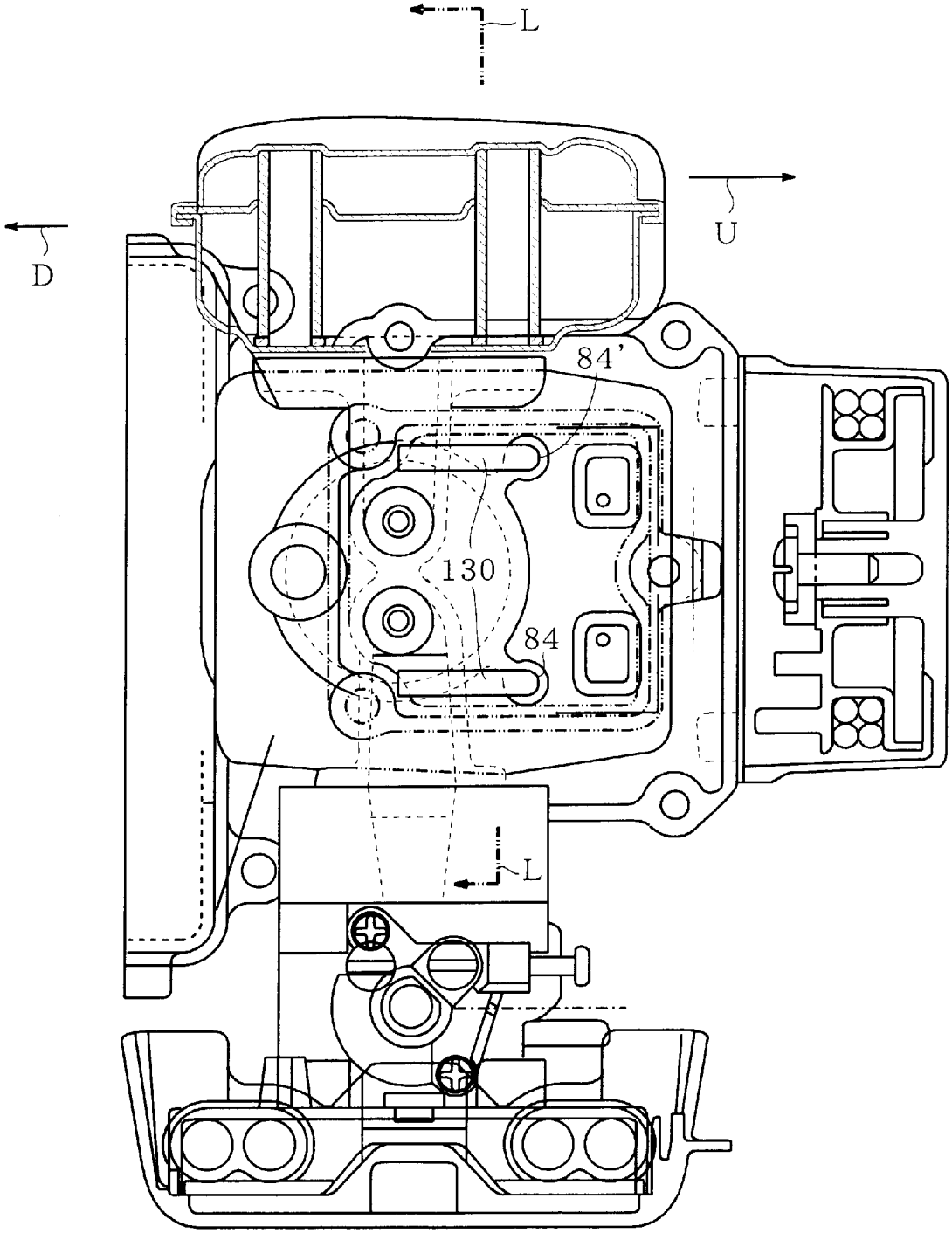
FIG. 6 is a view taken along the direction shown by symbols B in FIG. 5.

In FIG. 4 and FIG. 6, each suction means 130 is composed of a flexible pipe formed in a curve so that the extremity thereof can be immersed into oil when the four-cycle engine 1 is put over sideways. In this connection, the oil level in the four-cycle engine 1 being put over sideways is shown by symbols L in FIGS. 4 and 6, for ease of description, and the oil is to be held in the side shown by the arrows extending from the lines designated by the symbols L. Besides, in FIGS. 4 and 6, the direction designated by a symbol U represents the upside, and the direction designated by a symbol D represents the downside of the engine being put over sideways.

Figure 7:
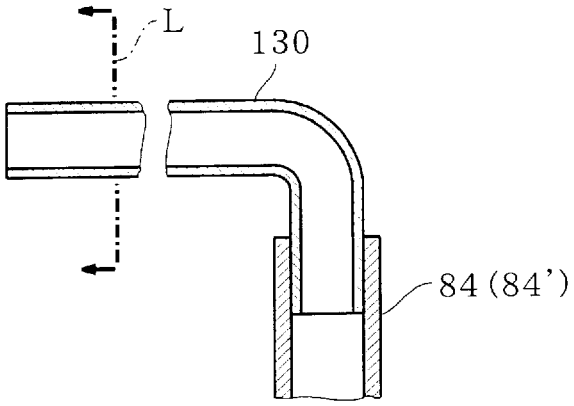
FIG. 7 is a partial sectional view for illustrating a main structure to be used in the lubricating apparatus of the four-cycle engine shown in FIG. 5.

As shown in FIG. 7, the oil suction means 130 are to be inserted into the openings of the oil returning channels 84 and 84' or fitted to the outer peripheries of the openings for retention. Thus, the oil suction means 130 in the inserted or fitted state can be detached from the oil returning channels 84 and 84' by pulling off from the openings. Therefore, the oil suction means 130 can be mounted on and detached from the oil returning channels 84 and 84' depending on the use conditions of the four-cycle engine. Note that, in FIG. 7, the lines designated by the symbols L and the arrows extending from the lines represent the same meanings as those in the above-described case.

The oil suction means 130 have their extensions from the bents set in length so that the extremities thereof can get into the oil.

Next, the another embodiment will be described with reference to FIG. 8.

Figure 8:
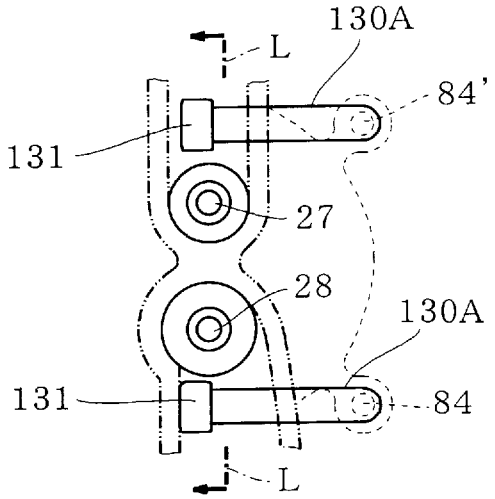
FIG. 8 is a partial view showing an extremity configuration of the main structure shown in FIG. 7.

In FIG. 8, the oil suction means (for ease of description, designated by symbols 130A) in the another embodiment are fitted by insertion into the oil returning channels 84 and 84' so as to rotate freely about the longitudinal axes of the channels. On the outer peripheries of the extremities thereof, as shown in FIG. 8, are mounted weight members 131 so as to direct the oil suction means 130A in the direction of gravity. Accordingly, when the engine 1 is set over sideways, the extremities can be directed toward the deepest position of the oil held inside the valve gear room 34 by means of the weights of the weight members 131.

As for yet another embodiment, the aforesaid oil suction means may be modified in their material properties.

Figure 9:
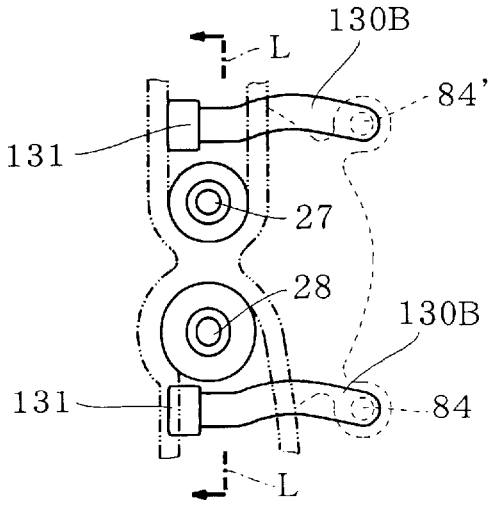
FIG. 9 is a partial view showing a modified example of the extremity configuration of the main structure shown in FIG. 7.

In FIG. 9, oil suction means (for ease of description, designated by symbols 130B) are composed of flexible pipes having weight members 131 mounted on the outer peripheries of their extremities. In this case, it is obvious that the oil suction means 130B have oil-resistance as well as flexibility.

In such constitution, even when the oil suction means 130B are set in length so that the extremities thereof are contacted with the internal walls of the valve gear room 34, their flexibility allows the extremities to be immersed into the oil, and permits the communication between the oil returning channels 84, 84' and the oil inside the valve gear room 34 in any position of the engine 1 including a sideways position. This accordingly allows the returning of oil from the inside of the valve gear room 34 to be securely carried out via the oil returning channels 84 and 84'.

In constitutions as described above, the extremities of the oil suction means 130, 130A, or 130B are kept immersed into the oil even in the cases where the engine 1 is put over sideways in use while the oil inside the valve gear room 34 moves to lower portions depending on the direction of the engine 1. Therefore, the communication can always be maintained between the oil in the valve gear room 34 and the oil returning channels 84 and 84', so that the returning of oil component from the valve gear room 34 to the oil sump 18 can be carried out securely.

While the presently preferred embodiments of this invention have been shown and described above, it is to be understood that disclosures are for the purpose of illustration and that various changes and modifications may be made without departing from the scope of the invention as set forth in the appended claims.

What is claimed is:

1. A lubricating apparatus for four-cycle engines having a communicating channel that provides communication between a crank room and a valve gear room, and a first oil feeding means for feeding oil mist in said crank room through said communicating channel to said valve gear room by means of a positive pressure generated in said crank room, and provided, for feeding oil from an oil sump provided in the vicinity of a crank room to said crank room and to a valve gear room containing an intake and exhaust valve mechanisms to carry out lubrication of parts and circulate the oil, wherein:

said oil sump is partitioned from said crank room so as to avoid oil leakage in any slanted state;

said lubricating apparatus further comprises a second oil feeding means having an inlet portion configured so that the extremity thereof always remains under the oil surface in said oil sump regardless of the slanted state of said oil sump, said second oil feeding means feeding the oil in said oil sump through said inlet portion to said crank room by means of a negative pressure generated in said crank room, an agitating section provided in said crank room for agitating the oil fed by said second oil feeding means into oil mist, and an oil inhaling channel branched from the middle of an oil returning channel so as to provide communication with an opening positioned in an immediate lower portion of a skirt of a piston being at the top dead center, said piston ascending and descending within a cylinder disposed along a vertical axis of said lubricating apparatus, said oil returning channel constituted by piercing so as to provide communication between said valve gear room and said oil sump; and an opening portion of said oil returning channel to said oil sump is provided with a check valve for opening when the engine is upright and closing when the engine is inverted or slanted.

2. The lubricating apparatus for four-cycle engines according to claim 1, wherein said check valve is composed of a spherical body for opening and closing said opening portion by means of its own weight.

3. The lubricating apparatus for four-cycle engines according to claim 1, wherein a pore for providing communication with said oil sump is arranged on said communicating channel.

4. The lubricating apparatus for four-cycle engines according to any one of claims 1 through 3, wherein a breather pipe is brought into communication from said valve gear room to a breather room of an air cleaner, and a pipe is arranged to provide communication between said breather room and an oil inhaling opening formed in an immediate lower portion of the skirt of said piston being at the top dead center of said piston in a cylinder, so as to feed the oil held in a lower part of said breather room into said cylinder through the oil inhaling opening in the immediate lower portion of said skirt when said piston is at the top dead center.

5. A lubricating apparatus for four-cycle engines having a communicating channel that provides communication between a crank room and a valve gear room, and a first oil feeding means for feeding oil mist in said crank room through said communicating channel to said valve gear room by means of a positive pressure generated in said crank room, and provided, for feeding oil from an oil sump provided in the vicinity of a crank room to said crank room and to a valve gear room containing an intake and exhaust valve mechanisms to carry out lubrication of parts and circulate the oil, wherein:

said oil sump is partitioned from said crank room so as to avoid oil leakage in any slanted state;

said lubricating apparatus further comprises a second oil feeding means having an inlet portion configured so that the extremity thereof always remains under the oil surface in said oil sump regardless of the slanted state of said oil sump, said second oil feeding means feeding the oil in said oil sump through said inlet portion to said crank room by means of a negative pressure generated in said crank room, an agitating section provided in said crank room for agitating the oil fed by said second oil feeding means into oil mist, and an oil inhaling channel branched from the middle of an oil returning channel so as to provide communication with an opening positioned in an immediate lower portion of a skirt of a piston being at the top dead center, said piston ascending and descending within a cylinder disposed along a vertical axis of said lubricating apparatus, said oil returning channel constituted by piercing so as to provide communication between said valve gear room and said oil sump; and said oil returning channel has an oil suction means detachably arranged on its opening in said valve gear room, said oil suction means being capable of immersing an extremity thereof into oil when the engine is put over sideways.

6. The lubricating apparatus for four-cycle engines according to claim 5, wherein said oil suction means is composed of a pipe formed from said oil returning channel so as to be bent toward the inside of the oil and rotate freely about the longitudinal axial center of said oil returning channel, and has a weight member mounted on said extremity to be immersed into the oil.

7. The lubricating apparatus for four-cycle engines according to claim 5, wherein: said oil suction means is formed of a flexible pipe, and has a weight member mounted on said extremity to be immersed into the oil.

* * * * *